United States Patent [19]

Oyama

[11] Patent Number: 4,460,083

[45] Date of Patent: Jul. 17, 1984

[54] FEED MECHANISM FOR ELONGATE FLEXIBLE ARTICLE

[75] Inventor: Yoshio Oyama, Asahi, Japan

[73] Assignee: Yoshida Kogyo K. K., Tokyo, Japan

[21] Appl. No.: 347,932

[22] Filed: Feb. 11, 1982

[30] Foreign Application Priority Data

Feb. 12, 1981 [JP] Japan ..... 56-19976

[51] Int. Cl.[3] ..... B65G 25/04

[52] U.S. Cl. ..... 198/486; 198/696; 271/85

[58] Field of Search ..... 198/486, 650, 694, 695, 198/696; 271/84, 85, 204, 206, 277; 414/69; 29/408

[56] References Cited

U.S. PATENT DOCUMENTS

| | | | |
|---|---|---|---|
| 1,854,775 | 4/1932 | Wichmann | 271/85 |
| 2,276,269 | 3/1942 | Dudley | 271/85 |
| 2,831,684 | 4/1958 | Cundall | 271/85 |
| 4,263,712 | 4/1981 | Schroder | 198/695 |
| 4,307,500 | 12/1981 | Kuse | 29/408 |

*Primary Examiner*—Trygve M. Blix
*Assistant Examiner*—Rodney Corl
*Attorney, Agent, or Firm*—Hill, Van Santen, Steadman & Simpson

[57] ABSTRACT

A feed mechanism for an elongate flexible article includes a pair of parallel grippers reciprocable between a first position and a second position for advancing the article along a longitudinal path. The grippers are closed at the first position to grip the article on a pair of spaced leading end portions thereof, and are opened at the second position to release the article. A removal lever, which has a first and a second leg, is disposed adjacent to the second position and is pivotable, in response to the arrival of the grippers at the second position, to cause the first leg to project through a space between the pair of grippers to kick down the article from the grippers while the latter are opened.

5 Claims, 14 Drawing Figures

PRIOR PROBLEM

FEED MECHANISM FOR ELONGATE FLEXIBLE ARTICLE

BACKGROUND OF THE INVENTION

1. Field of the Invention

The present invention relates to a feed mechanism for use in transporting an elongate flexible article such as a slide fastener from one station to another in an apparatus for manufacturing such articles.

2. Prior Art

In the manufacture of slide fasteners, a pair of interengaged slide fastener stringers of a continuous length is fed into a finishing station where the individual slide fastener is finished by mounting a slider onto the continuous slide fastener stringers, applying end stops to the same, and severing a slide fastener length from the continuous slide fastener stringers. The finished slide fastener is then fed to a packing station by means of a conveyor. To this end, it has been a common practice to draw the slide fastener by means of reciprocable grippers out of the finishing station to a predetermined position where the article is released from the grippers onto the conveyor. In order to maximize the rate of production, the grippers are returned to the finishing station as soon as the preceding article has been fed and released; that is to say, the grippers start to return with the article incompletely released therefrom. Consequently, with the prior art it is difficult to place the articles in proper position and posture on the conveyor. With the prior art, the grippers start to return with the article incompletely released therefrom such as shown in FIG. 13, and for this reason, it is difficult to place the articles in proper position and posture on the conveyor, such inadequate placement being shown in FIG. 14.

SUMMARY OF THE INVENTION

According to the present invention, a feed mechanism, for an elongate flexible article, comprises a pair of parallel grippers reciprocable between a first position and a second position for advancing the article along a longitudinal path. The grippers are closed at the first position to grip the article on a pair of spaced leading end portions thereof, and is opened at the second position to release the article. A removal lever, which has a first and a second leg, is disposed adjacent to the second position and is pivotable, in response to the arrival of the grippers at the second position, to cause the first leg to project through a space between the pair of grippers to kick down the article from the grippers while the latter are opened.

It is accordingly an object of the invention to provide a feed mechanism with which an elongate flexible (finished) article drawn from a finishing station can be released exactly at a predetermined position and hence can be placed in proper position and posture on a conveyor that conveys the article to a packing station.

Another object of the invention is to provide a feed mechanism with which rapid transportation of the articles from a finishing station to a packing station can be achieved.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION OF A PREFERRED EMBODIMENT

Figure 1:
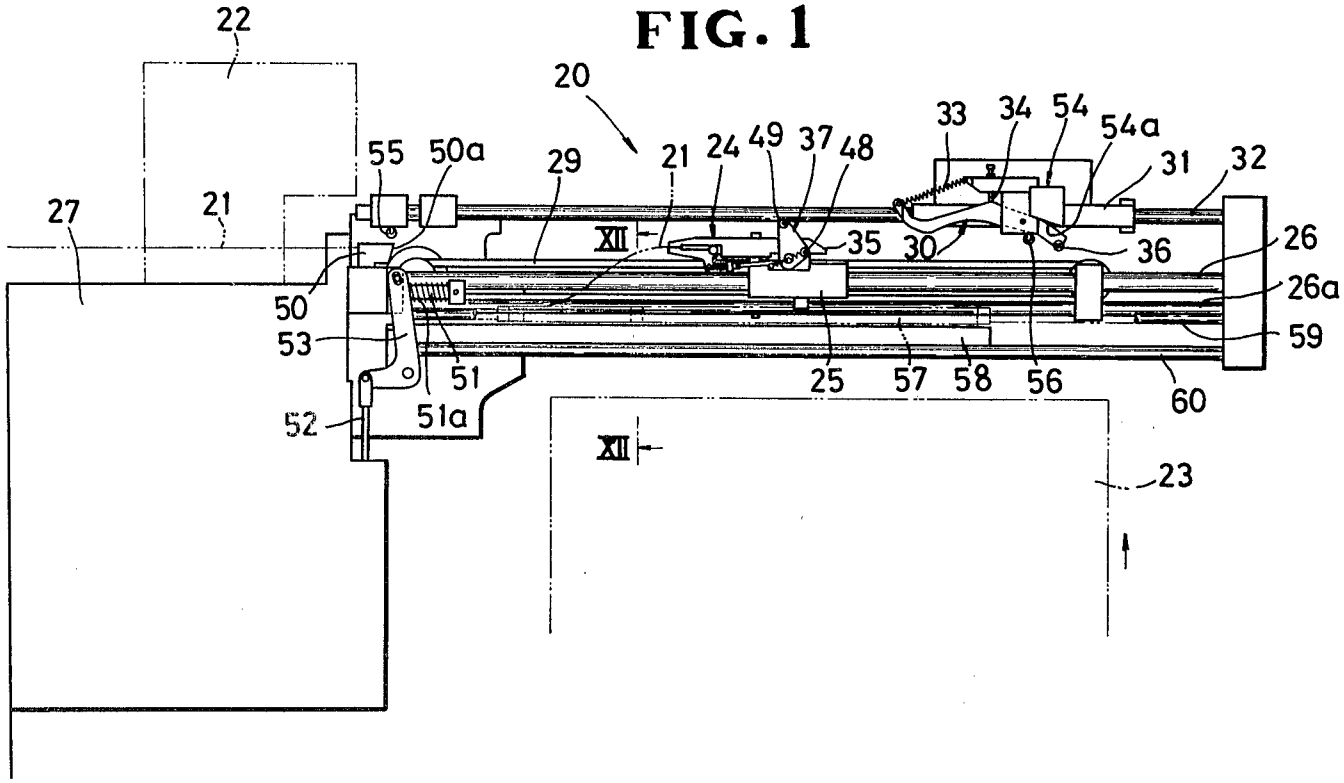
FIG. 1 is a front elevational view of a feed mechanism according to the present invention.

The principles of the invention are particularly useful when embodied in a feed mechanism such as shown in FIG. 1, generally indicated by the numeral 20. The feed mechanism 20 is adapted to feed an elongate flexible article, such as a finished slide fastener 21, from a finishing station 22 to a predetermined position (described below) from where the slide fastener 21 is conveyed to a packing station (not shown) by means of a conveyor 23. The slide fastener 21 has a slider 70 (FIGS. 7–12) threaded onto a pair of slide fastener stringers.

The feed mechanism 20 comprises a pair of horizontally spaced parallel grippers 24,24 for gripping the slide fastener 21 on a pair of laterally spaced leading end portions **21*a*,21*a* (FIGS. 3 and 7–11). The grippers 24,24 are reciprocable between a first position adjacent to the finishing station 22 and a second position away from the first position, there being means (described below) operative on the grippers 24,24 for closing the grippers 24,24 at the first position and for opening the grippers 24,24** at the second position.

Figure 2:
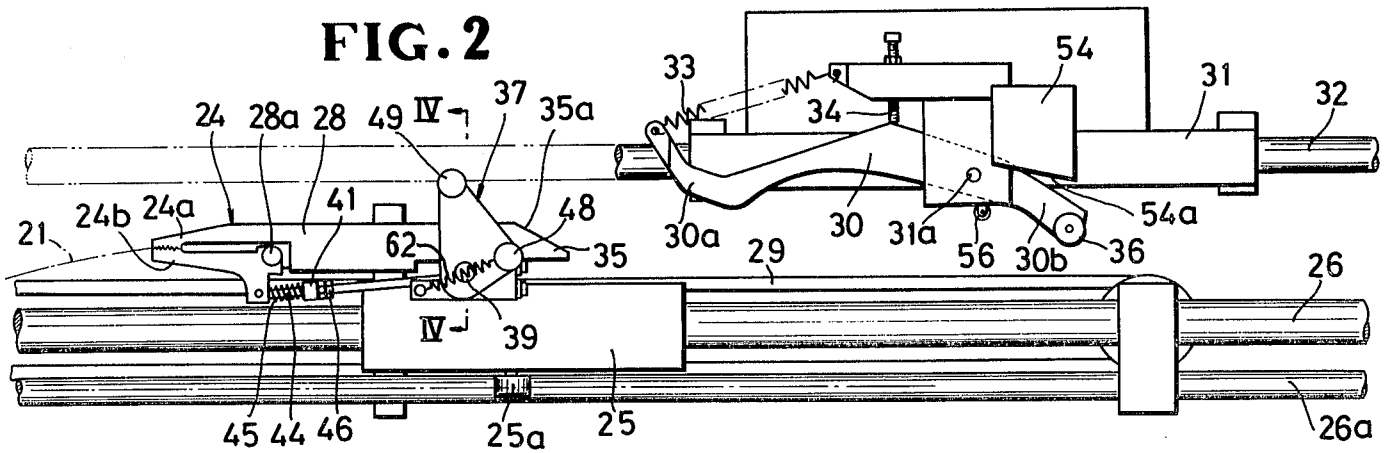
FIG. 2 is an enlarged view showing a portion of FIG. 1, with parts broken away.
Figure 3:
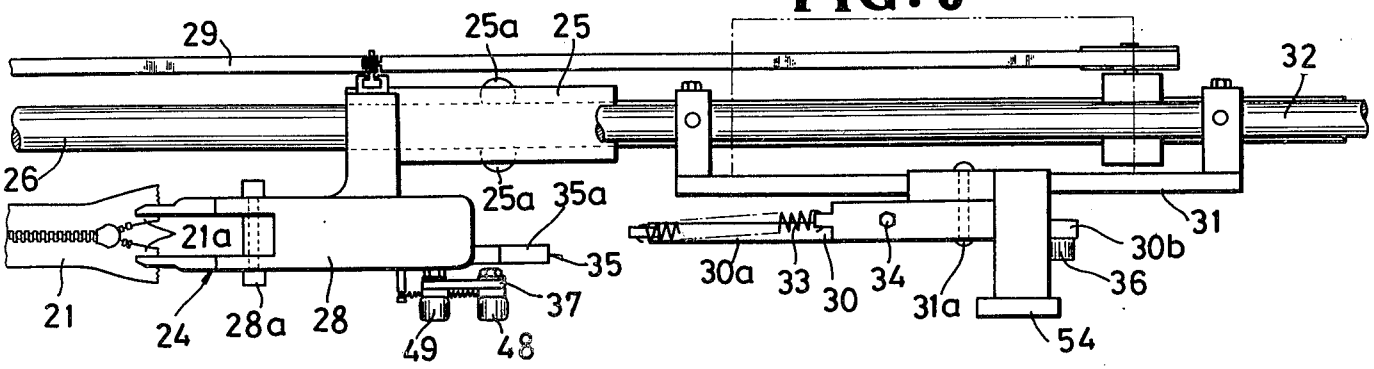
FIG. 3 is a plan view corresponding to FIG. 2.

As best shown in FIGS. 2 and 3, the grippers 24,24 are supported by a slide 25 slidably mounted on a first guide rail 26 projecting horizontally from a frame 27 (FIG. 1). A pair of rollers **25*a*,25*a* is mounted on the bottom of the slide 25 and rolls one on each side of an auxiliary guide rail 26*a* extending parallel to the first guide rail 26, thus preventing the grippers 24,24 from being angularly displaced about the first guide rail 26 during linear movement therealong. Each of the grippers 24,24 includes a pair of coacting upper and lower grip members 24*a*,24*b*. The two upper grip members 24*a*,24*a* project from a common first base 28 fixed to the slide 25, and the two lower grip members 24*b*,24*b* are pivotally mounted on the first base 28** by means of a pin 28*a*. The slide 25 is fixed to a reciprocably driven endless belt 29 extending alongside the first guide rail 26. Thus, the grippers 24,24 are reciprocably movable along the first guide rail 26 for advancing the slide fastener 21 along a longitudinal path.

The feed mechanism 20 further comprises a removal lever 30 pivotally mounted on a second base 31 adjustably mounted on a second rail 32 extending parallel to the first guide rail 26, the second base 31 and thus the removal lever 30 being disposed adjacent to the second position. The removal lever 30 has a first leg 30*a* and a second leg 30*b*. An extension spring 33 is mounted between a free end of the first leg 30*a* and the second base 31 to normally urge the removal lever 30 to pivot clockwise about a pin 31*a*; that is, the first leg 30*a* is normally urged upwardly. Such pivotal movement of the removal lever 30 is restricted by a stop 34 adjustably mounted on the second base 31.

A first cam platee 35 is carried by the first base 28 remotely from the grippers 24,24 and has a cam surface 35*a* slanting down to the right (FIGS. 1, 2 and 3). When the grippers 24,24 approach to the second position, a first roller 36 mounted on a free end of the second leg 30*b* of the removal lever 30 rolls on and along the cam surface 35*a*, causing the removal lever 30 to pivot counterclockwise against the bias of the spring 33 until the first leg 30*a* projects through a space between the pair of grippers 24,24 to kick down the slide fastener 21 from the grippers 24,24 while the latter are opened, as illustrated in FIGS. 8–11.

Figure 11:
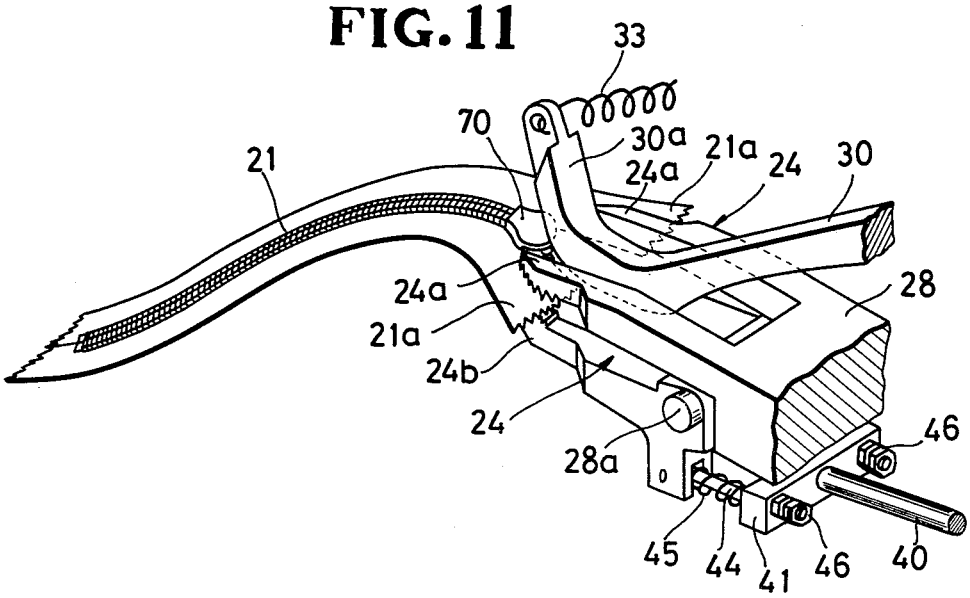
FIG. 11 (appearing with FIG. 7) is an enlarged perspective view corresponding to FIG. 9.
Figure 8:
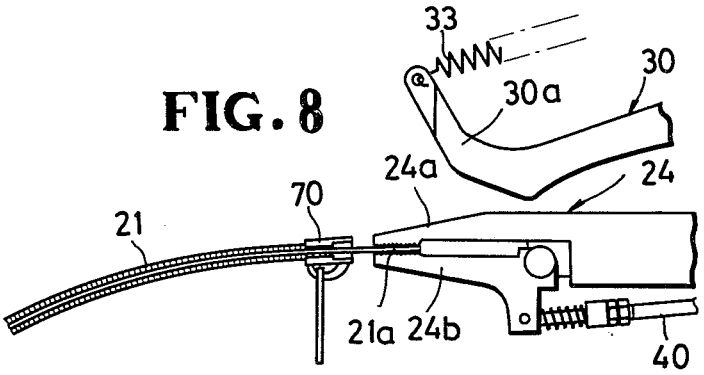
FIGS. 8, 9 and 10 are detail front elevational views showing the manner in which the slide fastener is kicked down from the grippers by means of a removal lever.

The closing and opening of the grippers 24,24 is controlled as follows. An actuator lever 37 of triangular shape is pivotably mounted on the first base 28 and is operatively connected to the lower grip members 24*b*,24*b* by a crank. The crank includes a double crank disk 38 (FIG. 4) mounted on a shaft 39 of the actuator lever 37, and a connecting rod 40 (FIG. 5) connected at one end to the crank disk 38 at a position eccentric to the shaft 39 and at the other end to a sliding bar 41 (FIGS. 2 and 11), the shaft 39 being journalled by a pair of bearings 42,42 each supported by a support block 43. As best shown in FIG. 11, the sliding bar 41 is slidably mounted on a pair of guide pins 44,44 pivotally connected at one end to the respective lower grip members 24*b*,24*b*. The sliding bar 41 is normally urged to move away from the lower grip members 24*b*,24*b* by means of a pair of compression springs 45,45. Such movement of the sliding bar 41 along the guide pins 44,44 is restricted by a pair of nuts 46,46 each adjustably mounted on the other end of the respective guide pin 44.

Figure 4:
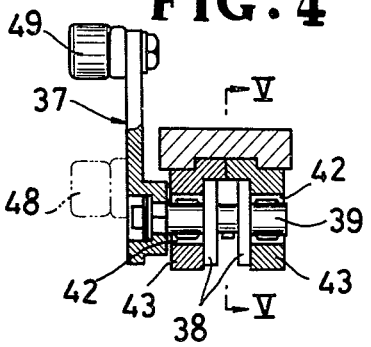
FIG. 4 is a cross-sectional view taken along line IV—IV of FIG. 2.
Figure 5:
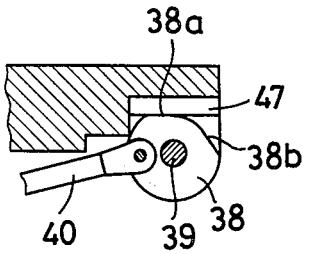
FIG. 5 is a cross-sectional view taken along line V—V of FIG. 4, showing a crank in its position as grippers are closed.
Figure 6:
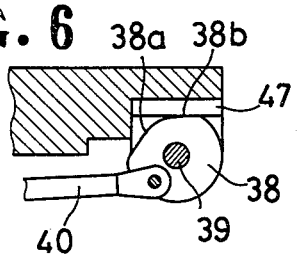
FIG. 6 is a view similar to FIG. 5, showing the crank in its position as grippers are opened.
Figure 14:
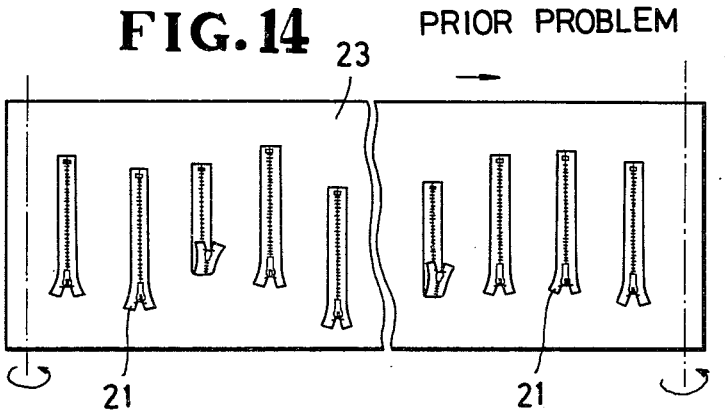
FIGS. 13 and 14 (the latter appearing with FIG. 4) are views showing prior problems.

As shown in FIGS. 4, 5 and 6, the crank disk 38 has a first and a second flat peripheral portion 38*a*,38*b* selectively engageable with a locking member 47 in response to pivotal movement of the actuator lever 37. The actuator lever 37 is pivotable between a "closing" position in which the grippers 24,24 are closed and in which the first flat peripheral disk portion 38*a* is in engagement with the locking member 47 (FIG. 5), and an "opening" position in which the grippers 24,24 are opened and in which the second flat peripheral disk portion 38*b* is in engagement with the locking member 47. The first and second flat peripheral disk portions 38*a*,38*b* with the locking member 47 serve not only to restrict the extent to which the actuator lever 37 is angularly moved, but also to hold the grippers 24,24 in closed position as they travel from the first position to the second position and then in opened position as they come back from the second position to the first position. Assurance that the flat pheripheral portions 38*a* and 38*b* will maintain engagement with the locking member 47 as shown in FIGS. 5 and 6 during travel of the slide 25 is provided by an over-center spring 62 (FIG. 2).

The triangular actuator lever 37 has a second roller 48 (FIG. 1) and a third roller 49 one on each free apex thereof. A second cam plate 50 is slidably mounted on a horizontal guide bar 51 extending as a cantilever from the frame 27 adjacent to the finishing station 22. The second cam plate 50 has a cam surface 50*a* slanting up to the right (FIG. 1) and is movable between a projected position in which the cam surface 50*a* is engageable with the second roll 48 when the grippers 24,24 are disposed at the first position, and a retracted position. The second cam plate 50, normally urged to the retracted position by means a compression spring 51*a*, is operatively connected to an actuator rod 52 by a bell crank 53. The actuator rod 52 is upwardly movable, in timed relation with the discharge of a freshly finished slide fastener 21 from the finishing station 22, to cause the second cam plate 50 to move to the extended position against the bias of the spring 51*a*. When the second cam plate 50 is moved to the extended position while the grippers 24,24 are at the first station, the second cam plate 50 pushes the second roller 48 carried by the actuator lever 37, thus causing the actuator lever 37 to pivot from the "opening" position to the "closing" position.

A third cam plate 54 is supported by the second base 31 and has a cam surface 54*a* slanting down to the right (FIGS. 1 and 2). When the grippers 24,24 approach the second position, the third roller 49 carried by the actuator lever 37 rolls on and along the cam surface 54*a*, causing the actuator lever 37 to pivot from the "closing" position to the "opening" position.

The extent to which the grippers 24,24 are reciprocably movable along the first guide rail 26 is restricted by a pair of limit switches 55,56 supported by the second rail 32 at positions adjacent to the first and second positions, respectively.

In order to receive and then transport the released slide fastener 21 onto the conveyor 23, a pair of first and second trays or pallets 57,58 is mounted on their respective support rails 59,60 extending parallel to the first guide rail 26. The slide fastener 21 having been released from the grippers 24,24 falls on the first pallet 57. The first pallet 57 is then inclined (phantom lines in FIG. 12) to allow the slide fastener product 21 to slide down to the second pallet 58, at which time the second pallet 58 is also inclined (solid lines in FIG. 12). Thence, the slide fastener 21 is transferred to the conveyor 23 by turning the second pallet 58 over (phantom lines in FIG. 12). Thus the slide fastener 21 is placed upside down on the conveyor 23. If it is unnecessary to turn the slide fastener 21 over, the second pallet 58 may be omitted. The conveyor 23 extends perpendicularly to the direction of the longitudinal path.

Figure 7:
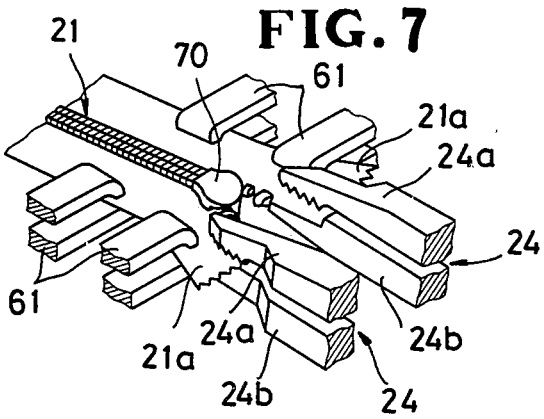
FIG. 7 is a fragmentary perspective view showing the grippers in their position as they have gripped leading end portions of a finished slide fastener drawn from a finishing station.

In operation, a freshly finished slide fastener 21 is drawn to an unnumbered outlet of the finishing station 22 by means of a number of grippers 61,61 (FIG. 7) in the finishing station 22. At that time the grippers 24,24 are disposed at the first position. The actuator rod 52 (FIG. 1) is raised, and the second cam plate 50 is thereby moved forward to push the second roller 48 carried by the actuator lever 37, thus causing the actuator lever 37 to pivot from the "opening" position to the "closing" position as the crank disk 38 is angularly moved from the position of FIG. 6 to the position of FIG. 5. As a result, the grippers 24,24 are closed to grip the slide fastener 21 on a pair of spaced leading end portions 21*a*,21*a*, as shown in FIG. 7.

Figure 9:
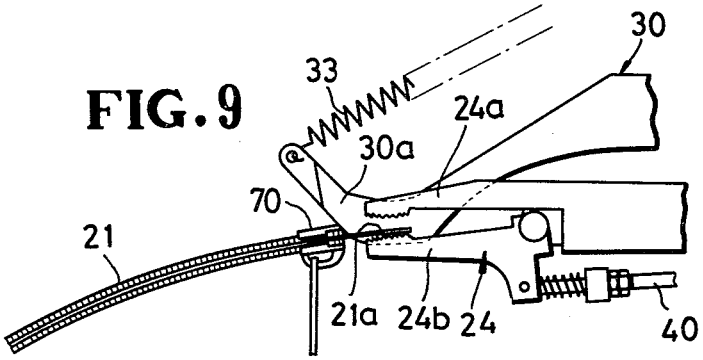
Figure 10:
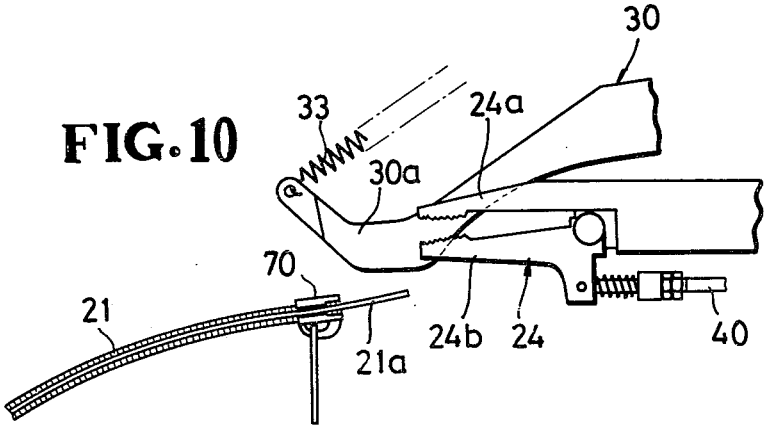
Figure 12:
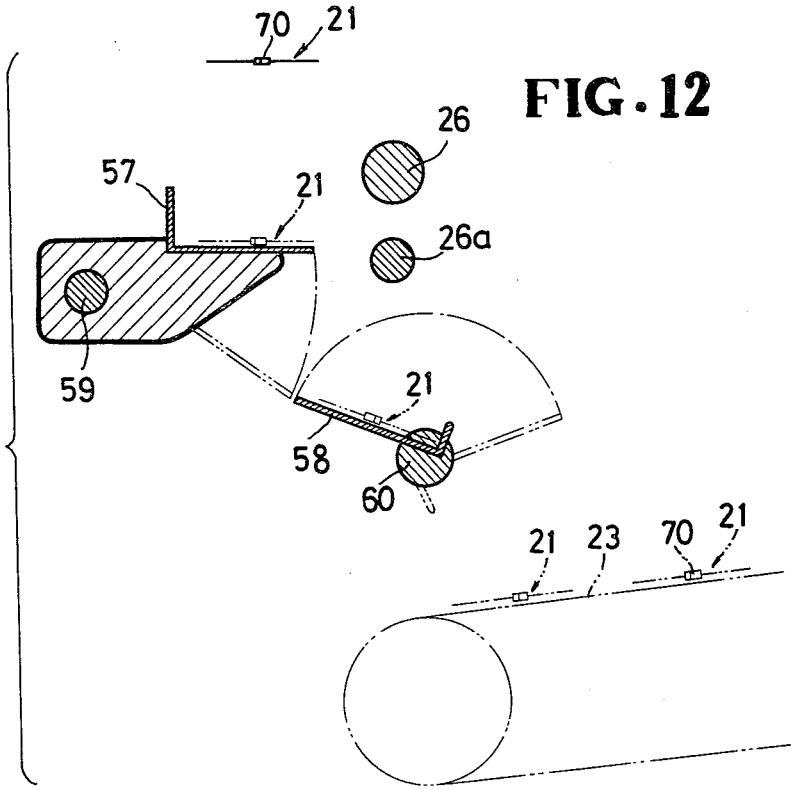
FIG. 12 is a cross-sectional view taken along line XII—XII of FIG. 1, showing the manner in which the successive slide fasteners released from the grippers are transferred onto a conveyor by means of pallets.
Figure 13:
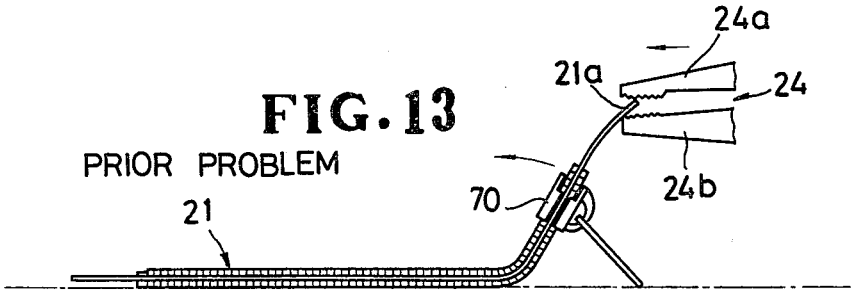

With the actuator lever 37 held in the "closing" position, the grippers 24,24 are then moved downstream along the first guide rail 26 until they reach the second position, bringing the leading end portions 21*a* of the slide fastener 21 to that position. As the grippers 24,24 approach the second position, the third roller 49 carried by the actuator lever 37 rolls on and along the cam surface 54*a* of the third cam plate 54, causing the actuator lever 37 to pivot from the "closing" position to the "opening" position; that is, the crank disk 38 is angularly moved from the position of FIG. 5 to the position of FIG. 6. Thus the grippers 24,24 are opened to release the slide fastener 21. At the same time the first roller 36 carried by the second leg 30*b* of the removal lever 30 rolls on and along the cam surface 35*a* of the first cam plate 35, causing the removal lever 30 to pivot so that the first leg 30*a* projects through a space between the pair of grippers 24,24 to kick down the slide fastener 21 from the grippers 24,24 while the latter are opened, as illustrated in FIGS. 9–11. The released slide fastener 21 falls onto the first pallet 57 and is thence transferred to the conveyor 23 via the second pallet 58. The conveyor 23 conveys the slide fastener 21 to the packing station (not shown).

After the slide fastener 21 has been completely released exactly at the second position, the grippers 24,24 are returned to the first position to grip the succeeding slide fastener 21.

With the feed mechanism 20, an elongate flexible article such as a finished slide fastener 21 drawn from a finishing station can be released exactly at a predetermined position and hence can be placed in proper position and posture on a conveyor that conveys the product to a packing station. Accordingly, rapid transportation of the successive articles from the finishing station to the packing station can be secured.

Although various minor modification may be suggested by those versed in the art, it should be understood that I wish to embody within the scope of the patent warranted hereon, all such embodiments as reasonably and properly come within the scope of my contribution to the art.

What is claimed is:

1. A feed mechanism for an elongate flexible article comprising:

(a) a pair of parallel grippers for gripping the article on a pair of laterally spaced leading end portions thereof, said grippers being reciprocable between a first position and a second position disposed away from said first position for advancing the article along a longitudinal path;

(b) means for supporting said grippers, said supporting means including a first rail extending parallel to said longitudinal path, and a slide slidably mounted on said first rail for movement therealong, said grippers being mounted on said slide ;

(c) each of said grippers including a pair of coacting upper and lower grip members, such two upper grip members projecting from a common first base fixed to said slide, such two lower grip members being pivotally mounted on said first base;

(d) means operative on said grippers for closing said grippers at said first position and for opening said grippers at said second position, said closing and opening means including:

(1) an actuator lever carried by said grippers and operatively connected to said lower grip members, said actuator lever being pivotable between a closing position in which said grippers are closed and an opening position in which said grippers are opened, said actuator lever carrying a second and a third roller;

(2) a second cam plate disposed adjacent to said first position and engageable with said second roller, when the grippers are disposed at said first position, to cause said actuator lever to pivot to said closing position; and (3) a third cam plate disposed adjacent to said second position and engageable with said third roller, in response to the arrival of said grippers at said second position, to cause said actuator lever to pivot to said opening position; and (e) a removal lever disposed adjacent to said second position and having a first and a second leg, said removal lever being pivotable, in response to the arrival of said grippers at said second position, to cause said first leg to project through a space between said pair of grippers for kicking down the article from said grippers while the latter are opened.

2. A feed mechanism according to claim 1, comprising means for reciprocably driving said slide along said first rail, said driving means including a reciprocably drivable endless belt extending parallel to said first rail, said slide being fixed to said endless belt.

3. A feed mechanism according to claim 1, including a first cam plate carried by said grippers, said removal lever having a first roller mounted on said second leg, said first cam plate being engageable with said first roller, when said grippers near said second position, to cause said removal lever to pivot in response to movement of said grippers in the direction of said longitudinal path.

4. A feed mechanism according to claim 1, said closing and opening means further including a crank connecting said actuator lever to said lower grip members, said crank including a crank disk mounted on a shaft of said actuator lever, and a connecting rod connected at one end to said crank disk at a position eccentric to said shaft and at the other end to said lower grip members.

5. A feed mechanism according to claim 1, comprising means for supporting said removal lever, the last-named supporting means including a second rail extending parallel to said first rail, and a second base mounted on said second rail, said removal lever being pivotally mounted on said second base.

* * * * *